United States Patent [19]
Poirier d'Ange d'Orsay

[11] 4,443,782
[45] Apr. 17, 1984

[54] METHOD FOR REGULATING THE VALUE OF A THICK FILM RESISTOR AND A CORRESPONDING RESISTOR

[75] Inventor: Emmanuel J. Poirier d'Ange d'Orsay, Castanet, France

[73] Assignee: S.E.V. Societe pour l'Equipement de Vehicules, Issy-les-Moulineaux, France

[21] Appl. No.: 355,563

[22] PCT Filed: Jun. 18, 1981

[86] PCT No.: PCT/FR81/00080
§ 371 Date: Feb. 18, 1982
§ 102(e) Date: Feb. 18, 1982

[87] PCT Pub. No.: WO81/03714
PCT Pub. Date: Dec. 24, 1981

[30] Foreign Application Priority Data

Jun. 19, 1980 [FR] France ..... 80 13643

[51] Int. Cl.[3] ..... H01C 10/00
[52] U.S. Cl. ..... 338/195; 29/620
[58] Field of Search ..... 338/195; 219/121 LH, 219/121 LJ; 29/620

[56] References Cited

U.S. PATENT DOCUMENTS

| | | | |
|---|---|---|---|
| 3,662,317 | 5/1972 | DiGarolamo et al. | 338/195 X |
| 3,889,223 | 6/1975 | Sella et al. | 338/195 |
| 4,100,525 | 7/1978 | Denes | 338/155 X |
| 4,163,315 | 8/1979 | Neese | 338/195 X |

FOREIGN PATENT DOCUMENTS

| | | | |
|---|---|---|---|
| 2337466 | 2/1975 | Fed. Rep. of Germany | 29/620 |
| 2437312 | 2/1976 | Fed. Rep. of Germany | . |
| 2067462 | 8/1971 | France | . |

OTHER PUBLICATIONS

H. S. Hoffman, *IBM Technical Disclosure Bulletin*, "Quick Trim High Aspect Ratio Resistor," vol. 22, No. 5, p. 1805, Oct. 1979.

*Primary Examiner*—C. L. Albritton
*Attorney, Agent, or Firm*—Brisebois & Kruger

[57] ABSTRACT

A method of regulating the valve of the resistance of a thick film resistive element. The resistive element comprises a resistive film (25) which bears on its edge two connection terminals (21, 22) and a connecting bar (24). The variation of the resistance is obtained by forming a slot (23) between the terminals, the slot being substantially perpendicular to the connection bar which connects the two parts of the resistive film separated by the said slot.

16 Claims, 7 Drawing Figures

FIG. 1
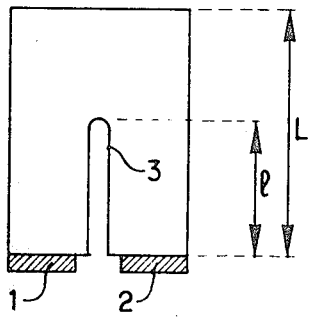
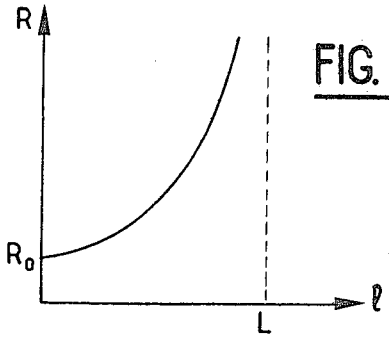
FIG. 2
FIG. 3
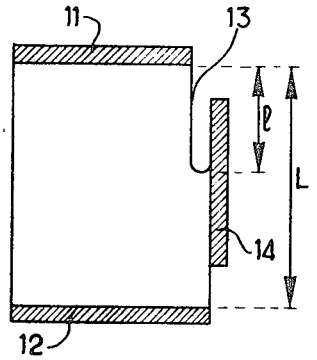
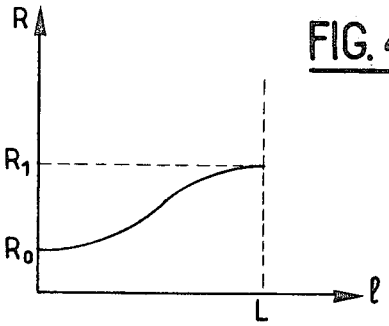
FIG. 4
FIG. 5
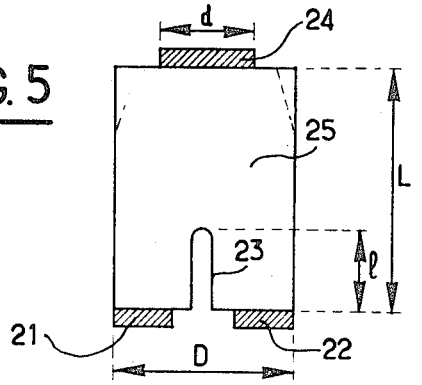
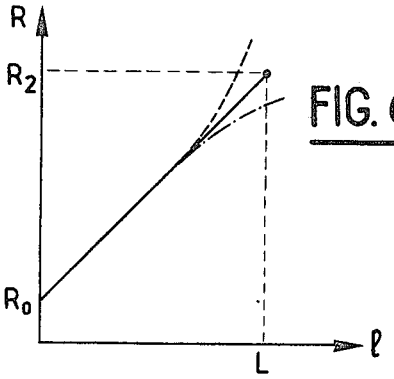
FIG. 6
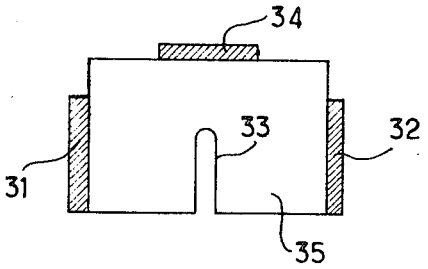
FIG. 7

METHOD FOR REGULATING THE VALUE OF A THICK FILM RESISTOR AND A CORRESPONDING RESISTOR

The invention relates to a method for adjusting the value of a thick film resistor to a desired value and to the corresponding resistor.

It is known that, in order to produce electronic circuits at a reduced cost price one is lead to use components, the characteristics of which are not very exact, such that a regulating element, which is adjusted in order to regain all the tolerances of the components, must be incorporated in the said circuit in order to bring the output values of the circuits to the desired level. This regulating element is generally a thick film resistor and, in a known manner, the regulating is performed by making a slot between the connection terminals of the resistor through the resistor film, the length of the slot enabling the electrical resistance of the element to be brought to the desired value. A slot of this type is produced either by means of a grinding machine, or by means of a laser beam, and it is naturally desired that the degree of accuracy of the regulation as a function of the length of the slot is as great as possible.

In the conventional type of thick film resistors, such as that which is illustrated in FIG. 1 of the drawing attached to the present application, the resistance increases with the length of the slot 3, the said slot being disposed in the resistor film between the two connection terminals 1 and 2. If the slot extends over the entire length of the element it is evident that the resistance will be infinite; it is therefore understood that the variation of the resistance R of the element as a function of the length 1 of the slot is represented by a curve of the type shown by way of example in FIG. 2 of the attached drawing. The degree of accuracy of the regulation which may be obtained by means of an element of this type is the greater, the less the inclination of the curve in FIG. 2: it is thus clear that, if the degree of accuracy is suitable for the lengths of slots 1 reduced with respect to the length L of the resistor, the said degree of accuracy becomes insufficient when the length of the slot is increased; the result of this is that an element of this type can only be used with a limited variation of the electrical resistance of the element if it is desired to maintain a suitable degree of accuracy. Thus it is evident that if the components of a circuit have high tolerances as regards their characteristics, it is necessary to be able to vary considerably the regulating element if it is desired to return the output value to the nominal value. In general it is considered necessary to be able to vary the resistance of a regulating element of this type in a ratio of 1 to 10. The resistors of the type shown in FIG. 1 of the attached drawing may only vary within a ratio of 1 to 4 approximately if it is desired to maintain a suitable degree of accuracy. In the prior art, for example in the German Offenlegungsschrift No. 2 337 466, it has been proposed that this disadvantage be overcome by using thick film resistors which have been shown in FIG. 3 of the attached drawing and which, in addition to the connection terminals 11 and 12 disposed on the edge of the film, likewise comprise a connecting bar 14 disposed on a region of the edge of the film which is not occupied by the connection terminals. According to this technique it has been proposed to produce the slot 13, which enables the resistance value to be regulated, parallel to the connecting bar: the slot thus progressively separates the connecting bar from the resistor film and, given that the connecting bar comprises a shunt conductor, it is clear that increasing the length of the slot enables the resistance of the element to be increased. In FIG. 4 the curve of the variation of the resistance of the element of FIG. 3 has been illustrated as a function of the length 1 of the slot 13 which is provided therein parallel to the connecting bar 14. In view of the fact that the two extreme values $R_0$ and $R_1$ of the resistance of the element are both finite values, the degree of accuracy of the regulation is satisfactory within the entire range in which the length 1 may be varied. It has unfortunately been observed that in practice, with an element of this type, the ratio of resistances $R_1$ and $R_0$ could not be greater than approximately 6, which is still not sufficient for the desired regulating elements.

The object of the pesent invention is to propose a novel method for regulating the value of a thick film resistor to a desired value. The method according to the invention enables, on the one hand, the resistance of the element to be varied within a very large ratio, going from 1 to 10 for example, and, on the other hand, a precisely constant degree of accuracy to be obtained within the entire field of the variation of the resistance. In other words, with the thick film resistor according to the invention the resistance variation may be a linear function of the length of the slot provided in order to effect the adjustment of the said resistor to the desired value. It is evident that the regulating method according to the invention and the corresponding resistor have a considerable advantage with respect to the prior art, since, on the one hand, they ensure a constant degree of accuracy within the entire regulating range and, on the other hand, they provide the possibility of varying the resistance of the element in proportions which are necessary in practice for operation of elements of this type. The fact that there is an exactly constant degree of accuracy enables the inertia of the machines to be compensated, this inertia being produced by the slots by controlling the stopping of the said machines at a predetermined value before the threshold desired, since the variation of resistance which corresponds to the length of the slot produced in proportion to the inertia of the machine is known in advance.

The object of the invention, therefore, is a method for regulating to a desired value the value of a thick film resistor comprising a resistive film disposed on an insulating support between two connection terminals, each of which is located on an edge region of the said film, a conductive connecting bar being, in addition, located on another edge region of the said film; and in this method, on the current path between the two terminals, a slot is made in the resistant film, the length of which slot enables the resistance between the terminals to be regulated, characterized in that the said slot is provided substantially perpendicular to the connecting bar, the said bar connecting the two parts of the resistant film separated by the slot.

In the method according to the invention, if the slot is made over the entire length of the resistive film and reaches the connecting bar, the element is in the form of two half-elements which are connected in series by means of the conductive connecting bar. In the prior art corresponding to the German patent application No. 2 337 466, when the slot was provided along the connecting bar over the entire length of the element, the resistant film remained as a single block; if it is assumed that this film theoretically comprised the assembly of two half-elements coupled parallel to the direction of the slot, the two half-elements thus would be positioned in parallel between the two connection terminals and not in series as they are when the method according to the invention is applied. It results from this difference that, by applying the invention, it is possible to obtain a variation in the resistance of the element which is much greater than for the resistance described in publication No. 2 337 466 cited above.

The object of the present invention is also the novel industrial product constituted by a thick film resistor the value of which has been regulated by the method defined above to the desired value, the said resistor comprising a resistive film disposed on an insulating support between the two connection terminals, a slot being provided between the said terminals which are located on an edge region of the said film, a conductive connecting bar being located on another edge region of the film, characterized in that the slot is substantially perpendicular to the connecting bar, the said bar connecting the two parts of the resistant film separated by the slot.

In one preferred embodiment the resistant film has a substantially rectangular shape; in a first variant the two terminals are substantially parallel and the connecting bar is substantially perpendicular to the terminals; in a second variant the two terminals are on the same side of the rectangle, which is formed by the resistant film, and the connecting bar is on the opposite side of the said rectangle. It may advantageously be provided that the connecting bar occupies only one part of the side of the rectangle where it is situated; the slot may be rectilinear; the axis of the slot preferably intersects the connecting bar; the axis of the slot is advantageously merged with the mid-perpendicular of the connecting bar. In order to profit from a constant degree of accuracy within the entire regulating range, the length of the connecting bar is selected such that the value of the resistance between the two terminals varies in a linear manner as a function of the length of the slot for a slot having a constant width.

In order to better understand the object of the invention there will now be described, by way of examples which are purely illustrative and non-limiting, two embodiments shown in the attached drawing, in which:

FIG. 1 shows a thick film resistor of the prior art;

FIG. 2 shows the resistance variation curve which may be obtained by means of the resistor of FIG. 1;

FIG. 3 shows another embodiment of a thick film resistor of the prior art;

FIG. 4 shows the resistance variation curve which may be obtained with the element of FIG. 3;

FIG. 5 shows a first embodiment of the resistor according to the invention;

FIG. 6 shows the resistance variation curve which may be obtained with the element of FIG. 5;

FIG. 7 shows a second embodiment of the resistor according to the invention.

FIGS. 1 to 4 relating to the prior art have been explained above and will not be dealt with in detail in the following description.

It may be seen from FIG. 5 that the resistor according to the invention comprises two connection terminals 21, 22, separated by the slot 23 provided in the resistive film 25 of the element. The resistive film 25 rests on a non-conductive support, has a substantially rectangular shape and, on its side opposite the side where the connection terminals 21 and 22 are arranged there is a conductive connecting bar 24. The axis of slot 23 is merged with the mid-perpendicular of the bar 24. The bar 24 extends over a length d which is shorter than the width D of the resistant film 25. The length of the slot 23 has been designated 1 and the length of the film 25 has been designated L.

In FIG. 6 the curves of the variation of the resistance R between the terminals 21 and 22 as a function of the length 1 of slot 23 have been illustrated. When the length of the slot is zero the resistance of the element is equal to $R_0$; when the slot reaches the connection bar 24 the resistance of the element is equal to $R_2$. The ratio $R_2/R_0$ may reach 10 in the case of elements having usual dimensions. The shape of the variation curve is essentially a function of the length d of the connecting bar 24. If the connecting bar is very small a curve such as that which is shown in dotted lines is obtained; if the connecting bar is very large a curve such as the one shown in a dot-dash line is obtained. If d has an intermediate value a curve which is precisely linear is obtained: the result of this is that the degree of accuracy of the regulation is exactly constant within the range of variation of the resistance between $R_0$ and $R_2$, which enables the degree of accuracy of the regulation relating to the circuit in which the element according to the invention is inserted to be increased, by compensating the inertia of the machines for forming the slots 23.

Should the curve in FIG. 6 not be exactly linear it is possible to act on the shape of the resistive film in order to recover linearity, for example as shown in diagrammatic form by dotted lines in FIG. 5, by rounding-off to a greater or lesser extent the angles of the film 25 which are on either side of the connecting bar 24.

FIG. 7 shows another embodiment of the resistor according to the invention. In this embodiment the resistive film 35 has a substantially rectangular shape and comprises the connection terminals 31 and 32 of the element on its two short sides opposite each other. The slot 33 which enables the resistance to be regulated, is parallel to the edges occupied by the terminals 31 and 32 and disposed half-way between these two edges. The connection bar 34 is arranged on the long side of the resistant film where the slot 33 has not been formed; the axis of slot 33 is merged with the mid-perpendicular of the connection bar 34. Although a configuration of this type always enables improved linearity and a greater range of regulation to be obtained, these are less remarkable than those connected with the configuration of FIG. 5.

It is understood that the embodiments described above are in no way limiting and may give rise to any desired modifications without departing from the scope of the invention.

I claim:

1. A thick film resistor, comprising resistive film disposed on an insulating support, said resistive film having edge regions, a first connection terminal on an edge region of the film, a second connection terminal spaced from the first terminal and on an edge region of the film, a conductive connection bar spaced from said terminals and on another edge region of the film, and a slot (23,33) formed in said film between said connection terminals (21, 22, 31, 32), said slot having a median line which is perpendicular to a median line of the connection bar (24, 34), and said connection bar electrically connecting the portions of the edge region of the resistive film which lie on opposite sides of the median line of the slot so that said connection bar forms a part of the current path between the portions of the resistive film on opposite sides of the median line of the slot.

2. A resistor according to claim 1, wherein said film (25, 35) has a substantially rectangular shape.

3. A resistor according to claim 2, wherein said terminals (31, 32) are substantially parallel and said connector bar (34) is in a plane substantially perpendicular to the terminals.

4. A resistor according to claim 2, wherein said terminals (21, 22) are on a common edge of the rectangular film (25), and said conductive bar (24) is on an opposite edge of the rectangular film.

5. A resistor according to one of claim 3 or 4, wherein said conductive bar (24) has a length less than the edge of the film on which it is located.

6. A resistor according to claim 1 wherein said slot (23, 33) is rectilinear.

7. A resistor according to claims 1 or 6 wherein the median line of the slot (23,33) intersects the connection ar (24, 34).

8. A resistor according to claim 7, wherein the median line of the slot (23,33) lies along the perpendicular bisector of the connection bar (24,34).

9. A resistor according to claim 1 wherein said slot (23, 33) has a constant width, and said conductive bar comprises means for varying the resistance between said terminals as a linear function of the length of the slot.

10. A resistor according to claim 1 wherein corners of the film (25, 35) on both sides of the connection bar (24, 34) are rounded off.

11. Method for changing to a desired value the value of a thick film resistor comprised of a resistive film disposed on an insulating support between two connection terminals, each of which is electrically connected to and located on an edge region of the film, and in which the resistance is the resistance of the current path between said terminals, the method comprising selecting a conductive connection bar, electrically connecting the connection bar along another edge region of the film in spaced relation to the connection terminals, forming in the film in the current path between the terminals, a slot having a median line perpendicular to the median line of the connection bar so that the connection bar electrically connects the edge region of and forms part of the current path between the two portions of the resistance film which lie on opposite sides of the median line of the slot, said step of forming the slot comprising forming a slot of a length to provide a resistance of a predetermined value in the current path between said terminals.

12. The method of claim 11 wherein said step of selecting a connection bar comprises selecting a connection bar of a length to cause the resistance of the current path between the terminals to vary linearly with the length of the slot.

13. The method of claim 11 or claim 12 wherein said resistive film comprises a film of generally rectangular shape.

14. The method of claim 11 wherein the connection bar is connected to an edge region of the resistive film which is longer than the bar, and the method further comprises removing portions of the resistive film at each end of the connection bar to further change the value of the resistance between the connection terminals.

15. The method of claim 14 wherein portions of the resistive film are removed by rounding corners of the edge of the film on which the connection bar is located.

16. The method of claim 12 wherein said film is a rectangular film and said step of forming said slot comprises forming only a single slot perpendicular to said connection bar.

* * * * *